US005311167A

United States Patent [19]

Plimpton et al.

[11] Patent Number: 5,311,167

[45] Date of Patent: May 10, 1994

[54] UV/IR FIRE DETECTOR WITH DUAL WAVELENGTH SENSING IR CHANNEL

[75] Inventors: Jonathan C. Plimpton, Northfield; George L. Minott, Wilton, both of N.H.

[73] Assignee: Armtec Industries Inc., Manchester, N.H.

[21] Appl. No.: 745,017

[22] Filed: Aug. 14, 1991

[51] Int. Cl.[5] ..... G08B 17/12

[52] U.S. Cl. ..... 340/578; 250/339.01

[58] Field of Search ..... 340/578, 587, 577; 250/338.1, 338.3, 339, 372, 554

[56] References Cited

U.S. PATENT DOCUMENTS

| | | | |
|---|---|---|---|
| 3,665,440 | 5/1972 | McMenamin | 340/578 |
| 4,199,682 | 4/1980 | Spector et al. | 250/339 |
| 4,206,454 | 6/1980 | Schapira et al. | 340/578 |
| 4,249,168 | 2/1981 | Muggli | 340/578 |
| 4,296,324 | 10/1981 | Kern | 250/339 |
| 4,455,487 | 6/1984 | Wendt | 250/339 |
| 4,459,484 | 7/1984 | Tar | 250/339 |
| 4,463,260 | 7/1984 | Ikeda | 250/339 |
| 4,471,221 | 9/1984 | Middleton | 250/339 |
| 4,718,497 | 1/1988 | Moore | 340/578 |

FOREIGN PATENT DOCUMENTS

| | | | |
|---|---|---|---|
| 2188416 | 9/1987 | United Kingdom | 250/339 |

OTHER PUBLICATIONS

Optical Coating Laboratory, Inc., *Stock Filter Catalog, Jan. 1990.*

Middleton, *Developments in Flame Detectors*, With Particular reference to p. 181, Jan. 1983.

*Primary Examiner*—Hezron E. Williams
*Assistant Examiner*—Christine K. Oda
*Attorney, Agent, or Firm*—Lorusso & Loud

[57] ABSTRACT

A system for automatically detecting fires fueled by hydrocarbons and certain non-organics including hydrogen, hydrazine, magnesium, aluminum, potassium, ammonia and silane, which system has a low incidence of false alarms from incident radiation emitted by non-fire radiation sources such as the sun. The system includes a UV sensor assembly that both senses UV radiation in a predetermined spectral bandwidth and generates a first signal corresponding to the sensed radiation; an IR sensing assembly consisting of a single IR sensor that simultaneously senses IR radiation in two predetermined spectral bandwidths and generates a second signal corresponding to the IR radiation in at least one of the spectral regions; and a signal processor. The UV spectral bandwidth is such that the UV sensing assembly is responsive to UV radiation emitted by hydrocarbons and certain non-organics but non-responsive to solar UV radiation. The IR spectral bandwidths are selected so that one spectral region is responsive to IR radiation emitted by hydrocarbons and certain non-organics while the other is responsive to hydrocarbons only. Both IR spectral regions are selected so as to be largely non-responsive to solar IR radiation. The signal processor processes the first and second signals and generates a fire signal when the processed signals are indicative of a fire.

47 Claims, 6 Drawing Sheets

UV/IR FIRE DETECTOR WITH DUAL WAVELENGTH SENSING IR CHANNEL

BACKGROUND OF THE INVENTION

The present invention relates generally to fire detectors, and more particularly concerns fire detectors that sense both ultra-violet (UV) wavelength radiation through a UV channel, and infrared (IR) wavelength radiation through an IR channel. In order to greatly increase performance, the IR channel senses two distinct wavelengths.

Numerous fire detection schemes exist in the prior art which involve the sensing of different combinations of various spectral bands which are emitted from flames. These bands are selected from the UV, visible, and IR spectral regions. A common objective of these various detection schemes is to detect flame in the presence of undesired background radiation sources. These undesired radiation sources include solar radiation, arc-welding, and lightning, and can cause false alarms. It is of course a goal of any fire detection system to avoid false alarms.

Examples of prior art fire detectors include that of U.S. Pat. No. 3,665,440 to McMenamin. McMenamin teaches of a fire detector having two optical sensors; a UV sensor which responds to radiation with wavelengths less than 440 nanometers, and an IR sensor which responds to radiation from 1.0 microns to 2.5 microns. This system could theoretically respond to both hydrocarbon and non-hydrocarbon fuels. Response level to hydrocarbon flames, however, will be significantly less than that of the present invention since hydrocarbon flames show very strong spectral emission near 4.4 microns, as well as emission in the 2.7 micron spectral region. The detection scheme of McMenamin does not respond to radiation near 4.3 microns. Additionally, the scheme of McMenamin includes a UV sensor which is not solar blind since response is allowed for UV wavelengths as long as 400 nanometers. Significant solar emission occurs in the spectral region of 295 to 400 nanometers.

Another advantage of the present invention over McMenamin is that the center wavelength position and bandwidth selected for detection of IR water band emission near 2.9 microns is better matched with the actual wavelength position and bandwidth of IR emission from non-hydrocarbon fuels such as pure hydrogen and hydrazine. McMenamin claims an IR channel centered near 2.5 microns, which is off-center from the region of strongest flame emission. Also, the IR band centered at 2.5 microns in McMenamin will be more responsive to solar radiation than the present invention since solar irradiance at sea level becomes large for wavelengths shorter than 2.5 microns. In addition, the IR bandwidth centered near 2.5 microns as in McMenamin leads to significant loss of signal with off-axis shift of the flame source relative to the detector. This is because of the shift toward shorter wavelength of bandpass which occurs in IR interference filters as a result of off-axis shift.

U.S. Pat. No. 4,199,682 to Spector et al. refers to a fire and explosion detector employing two optical sensors; a UV sensor which responds to radiation with wavelengths less than 300 nanometers and an IR sensor which responds to radiation from 2.5 microns to 2.75 microns.

Spector is similar to the invention of McMenamin except that the UV sensor in Spector is disclosed as having spectral response such that the UV sensor is solar blind. Additionally, the IR sensor in Spector is restricted to response in the 2.5 micron to 2.75 micron region. These differences would make the response of Spector to solar radiation less than that associated with McMenamin. But, as compared with the present invention, Spector would show weaker response to non-hydrocarbon flames because of the narrower bandwidth of IR detected by the IR sensor in Spector and because of the choice of center wavelength for this band in Spector which is not centered on the maximum of the spectral emission of the water band from such flames as hydrogen. As with McMenamin, Spector would be less responsive to hydrocarbon flames than is the present invention. This is due to Spector's lack of response to 4.4 micron emission. Additionally, the existence of water, ice or snow on the window of the IR sensor would render Spector incapable of detecting a fire since they largely absorb the 2.5 micron to 2.75 micron radiation.

Another example of a prior art fire detector is that of U.S. Pat. No. 4,206,454 to Schapira et al. Schapira refers to a flame detector having two optical sensors, an IR sensor which responds to radiation in a narrow band at 4.3 microns and a second IR sensor which responds to a narrow band at 2.7 microns. Schapira provides a means to sense hydrocarbon fires since detection is accomplished in two IR spectral regions, 2.7 microns and 4.3 microns. Hydrocarbon fires show significant levels of IR spectral emission in these two regions. Schapira, however, only produces a response to a fire if the intensity level of the sensor with the 4.3 micron filter exceeds the intensity level of the sensor with the 2.7 micron filter. Non-hydrocarbon fires will not be detected since they have no 4.3 micron emission. Also, it is likely that Schapira could produce a false alarm response when solar radiation is present in combination with a blackbody source (a heated object) with temperature below 1000 degrees Kelvin (°K.). In the present invention, solar radiation in combination with a blackbody whose temperature is less than about 1500° K. will not cause a false alarm since the UV channel would provide no response.

Another prior art reference is that of U.S. Pat. No. 4,455,487 to Wendt. Wendt refers to a two channel fire detector system with an IR and UV ratio detector. The UV sensor is responsive to UV radiation over the wavelength range 190 nanometers to 270 nanometers while the IR sensor is responsive to IR radiation in a bandwidth of 4.1 microns to 4.7 microns. Signal processing electronics in each channel produce a normalized output signal proportional to the power of incident IR and UV radiation within specific bandwidths. The system features a ratio detector that repeatedly forms a ratio of the normalized IR and UV inputs and compares the ratio to a known range of values, the known range of values being characteristic of fires. A discriminator connected to the output of the ratio detector generates a fire alarm signal only if the majority of these ratio comparisons are fire indicating. The system also includes a feedback loop in the IR processing channel that automatically adjusts the output of the channel to compensate for time varying background IR radiation such as sunlight.

Another prior art fire detector is disclosed by U.S. Pat. No. 4,463,260 to Ikeda. Ikeda discloses a flame detector comprised of three IR channels. One IR sensor is responsive to a band of radiation centered near 2.5 microns. The second IR sensor is responsive to a band of radiation centered near 3.5 microns. The third IR sensor is responsive to a band of radiation centered near 4.3 microns. Successful detection of a hydrocarbon flame depends upon sensing the larger signals from both the 2.5 micron and 4.3 micron channels in relation to the magnitude of the signal sensed by the 3.5 micron channel. One problem with this scheme is the inability to detect flames from non-hydrocarbon fuels which show no emission near 4.3 microns. In addition, it appears that a heated object whose temperature is less than 1000° K. which produces a relatively high irradiance level, in combination with solar radiation, could produce a false indication of fire. Additionally, if water or ice cover the 2.5 micron IR sensor, a hydrocarbon flame would not be detected since response from that sensor would be very small. Another disadvantage of Ikeda is that it requires three discrete sensor channels to detect a hydrocarbon fire, as opposed to the present invention, which requires only two sensor channels.

The final prior art reference is the Model FS2000 Multispectrum Optical fire sensor system, manufactured by The Fire Sentry Corp., 1401A Warner Ave, Tustin, Calif. 92680 (patent pending). The FS2000 has a three channel optical fire detection system having three optical sensors. One sensor is responsive to UV radiation within the spectral band 185 nanometers to 260 nanometers. The second sensor is responsive to visible radiation within the spectral band 400 nanometers to 700 nanometers. The third sensor is responsive to radiation with the spectral band 0.7 to 3.5 microns.

One disadvantage of the FS2000 is that it will not be as sensitive to hydrocarbon flames as the present invention since the FS2000 does not sense the very strong carbondioxide emission band near 4.3 microns.

A second disadvantage with the FS2000 is that solar radiation combined with a source of UV radiation such as arc-welding could conceivably result in a false alarm or false indication of fire. This is because solar radiation is very strong throughout the visible spectral region (400 nanometers to 700 nanometers) and for most of the IR spectral region from 0.7 microns to 3.5 microns, with the exception of several atmospheric water vapor and carbon dioxide absorption bands (the principal water absorption band resides in the 2.5 micron to 2.9 micron region where solar irradiance at sea level is negligible). Therefore, in the system of the FS2000, solar radiation would yield large responses from both the sensor channel responsive to 400 nanometers to 700 nanometers and the sensor channel responsive to 0.7 micron to 3.5 microns. Solar radiation would not generate a response from the UV channel, but, the presence of any UV emitting source such as an arc or spark in the presence of sunlight could activate all three channels, and result in a false alarm condition. It is conceivable that a false alarm condition may also result if a UV emitting source such as an arc or a spark is present in conjunction with a second radiating source which emits strongly in the spectral regions 400 nanometers to 700 nanometers as well as in the region from 700 nanometers to 3.5 microns. Many blackbody radiators could provide the function of this second radiating source.

A third disadvantage of the FS2000 fire detection system is that it requires the use of three discrete sensors in order to detect flame from hydrocarbon and non-hydrocarbon fuels. The present invention is less complex in that this result is achieved by use of only two discrete optical sensors, and, in the preferred embodiment, the IR sensor includes a single IR filter and a single active element.

Accordingly, it is the object of the invention to to create a fire detection system with the ability to respond to fires from both hydrocarbon or organically based fuels as well as from certain non-hydrocarbon or inorganically based fuels, including certain metals.

It is another object of the invention to create a fire detection system capable of detecting fires from hydrocarbon and non-hydrocarbon fuels with minimum interference from radiation emitted from non-fire sources including blackbody, solar radiation, arc-welding and lightning.

It is yet another object of the invention to create a fire detection system that maximizes the sensitivity of the fire detector to fire from certain non-hydrocarbon fuels, including, but not limited to, hydrogen and pure hydrazine. Also detected would be flame emission from certain metals including, but not limited to, magnesium, aluminum, sodium and potassium. Also included is the ability to detect flame from chemicals such as ammonia and silane, without increasing the response level of the fire detector to the non-fire or potential false alarm sources noted above.

It is still yet another object of the invention to create a fire detection system that has improved IR channel response to fire from clean-burning hydrocarbon fuels such as methane, ethane, propane, butane and their associated alcohols.

It is still yet another object of the invention to create a fire detection system that has improved IR channel response to fire from heavy hydrocarbon fuels (both long chain and cyclic types, both saturated and unsaturated) such as gasoline, kerosene, jet fuels, diesel fuel, benzene and toluene.

It is still yet another object of the invention to create a fire detection system that can accomplish the above identified objectives by using a two channel UV/IR system employing as few radiation sensors as possible, those sensors being of the simplest design possible.

SUMMARY OF THE INVENTION

The present invention features a UV/IR fire fire detector with dual wavelength sensing IR channel that automatically detects flames in a preselected zone with an extremely low incidence of false alarms due to non-flame radiation. The invention comprises a UV wavelength radiation sensing channel that is configured to sense UV radiation in the 195 nanometer to 275 nanometer spectral region. The invention also comprises an IR wavelength radiation sensing channel that is configured to simultaneously sense IR radiation in two spectral regions, one spectral region being centered at the 2.9 micron spectral line and the other region being centered at the 4.4 micron spectral line. Both the UV sensing channel and the IR sensing channel provide their outputs to signal processing circuitry that generates a fire signal if the signals created by the channels are indicative of a fire. The IR sensing channel provides an output signal when IR radiation is sensed in at least one of the IR spectral regions. The inventions ability to sense IR radiation in two separate and distinct spectral regions allows it to detect fires fueled by certain non-hydrocarbons or inorganically based fuels including but not limited to hydrogen and pure hydrazine; certain metals, including but not limited to magnesium, aluminum, sodium, and potassium; certain chemicals such as ammonia and silane; and/or hydrocarbons. These fire sources have spectra or radiation emissions in the UV spectral region and in at least one of the IR spectral regions of the present invention. The present invention's ability to selectively sense both UV and IR radiation and to generate a fire signal when the signals outputted by the UV and IR channels are indicative of a fire, provides the invention with the capability to detect fires fueled by any of the above identified materials with an extremely low incidence of false alarms caused by UV and IR radiation from non-fire sources, such as the sun, arc, welding, and lightning.

BRIEF DESCRIPTION OF THE DRAWINGS

Other objects and advantages will become apparent upon reading the following detailed description and upon reference to the drawings, in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE PREFERRED EMBODIMENT

Figure 1:
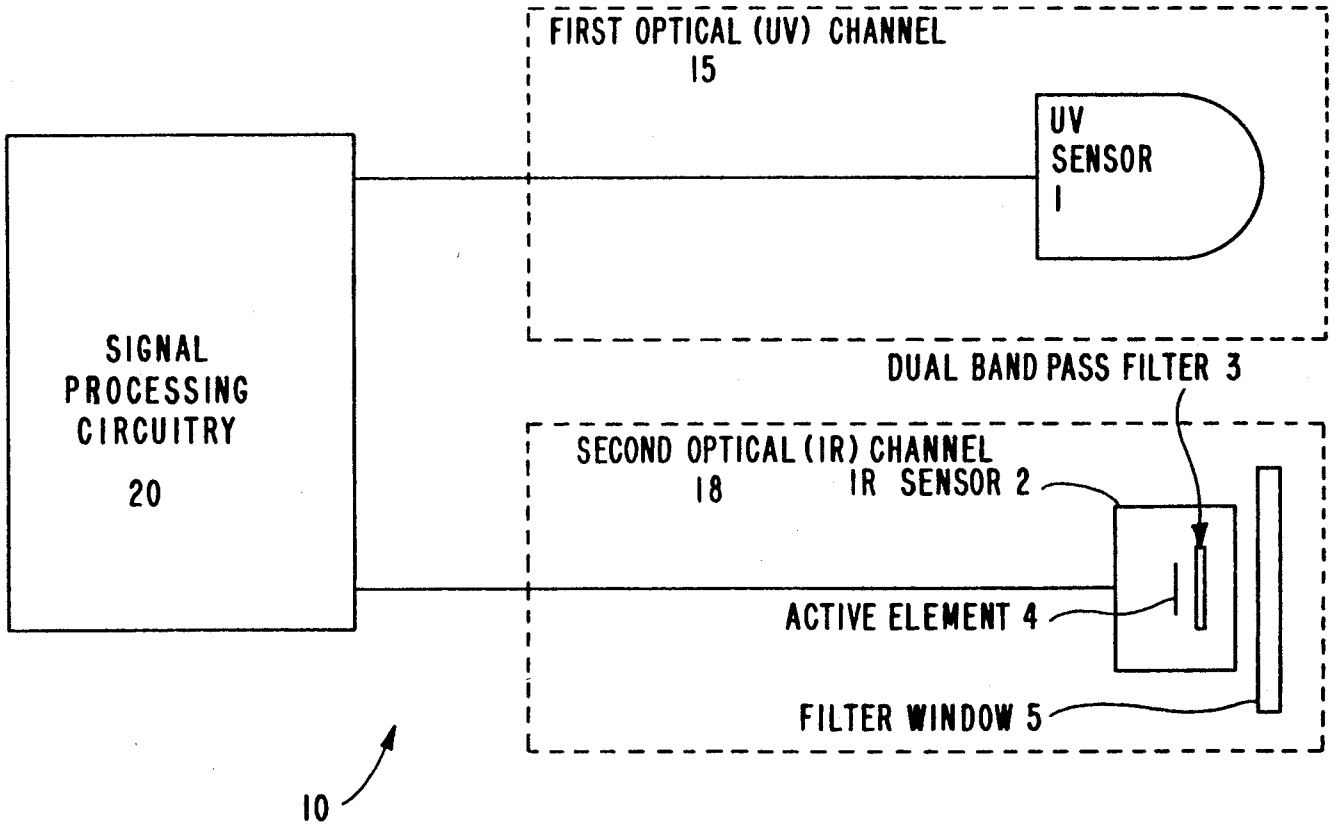
FIG. 1 is a block diagram of a preferred form of the invention.

Turning first to FIG. 1, there is shown a block diagram of a preferred embodiment of the UV/IR fire detection system (10) with dual wavelength sensing IR channel. Fire detection is afforded by sensing of radiant emission from flame using two discrete optical sensing channels. A first channel (15) senses UV radiation in the spectral region from 195 to 275 nanometers. A second channel (18) senses IR radiation in two band pass regions, each being several tenths of microns in width with center wavelengths positioned near 2.9 microns and 4.4 microns. Output signals from the first optical channel (15) and second optical channel (18) are input to signal processing electronic circuitry (20) of the fire detection system (10). One example of such signal processing circuitry (20) is that associated with the fire detection system disclosed in U.S. Pat. No. 4,455,487, assigned to the assignee of the present invention. In the preferred form of the invention, a UV sensor (1) forms part of the first optical channel (15), and is of the gaseous discharge type specified in U.S. Pat. No. 4,455,487. An IR sensor (2) forms part of the second optical channel (18), and is comprised of an IR sensor active element (4), which may provide a low voltage output signal and/or an output signal proportional to the intensity of the sensed IR radiation, and an IR optical dual bandpass filter (3) which has transmission in two spectral bandpass regions. The two regions are centered near 2.9 microns and 4.4 microns.

In an example of its application, the present invention provides an indication of hydrocarbon flame when a sufficient magnitude of response is detected by the UV sensor (1) and the IR sensor (2), and when the relative magnitude of response of the first channel (15) to the second channel (18) resides within certain predetermined ranges. This is in accordance with the signal processing circuitry (20), as disclosed in U.S. Pat. No. 4,455,487.

The fire detector (10) provides for response to certain non-hydrocarbon flame sources such as hydrogen by simultaneously sensing UV and IR emission from the hydrogen flame. UV emission is sensed by the solar blind UV sensor (1) while IR emission in the spectral region of 2.9 microns is sensed by IR sensor (2) equipped with the IR optical dual bandpass filter (3).

The invention provides for effective immunity to non-fire radiation sources such as solar radiation, arc-welding, lightning, and certain blackbody sources, as well as certain combinations of these.

Figure 3:
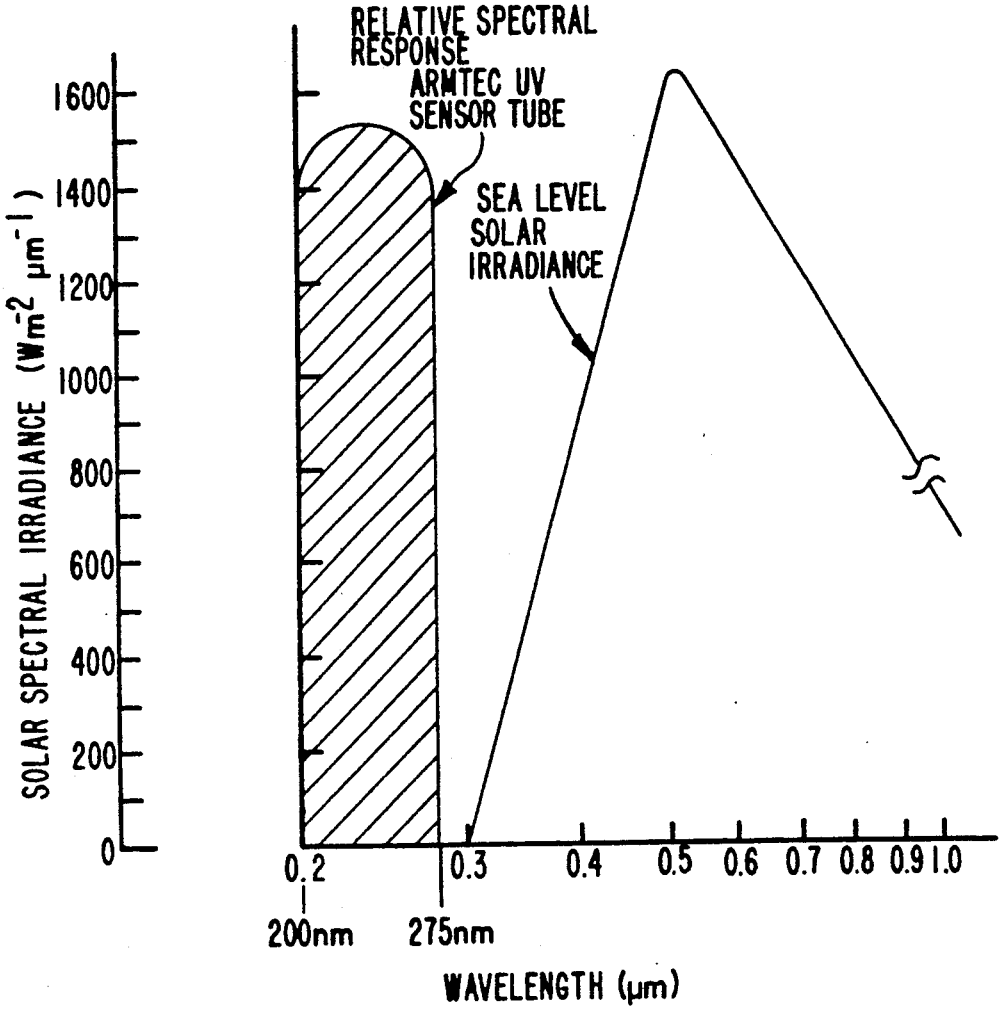
FIG. 3 is a graph plotting the solar spectral irradiance (in $Wm^{-2}\mu m^{-1}$) versus wavelength (in $\mu m$). It shows the spectral response of the UV sensor of the present invention.

Reference to FIG. 3 shows the spectral response of the UV sensor (1) of the present invention. Since spectral response is restricted to a bandwidth of 195 nanometers to 275 nanometers, response of the UV sensor (1) to sea level solar radiation is negligible. This is because sea level solar irradiance does not extend to wavelengths shorter than 295 nanometers.

Figure 4A:
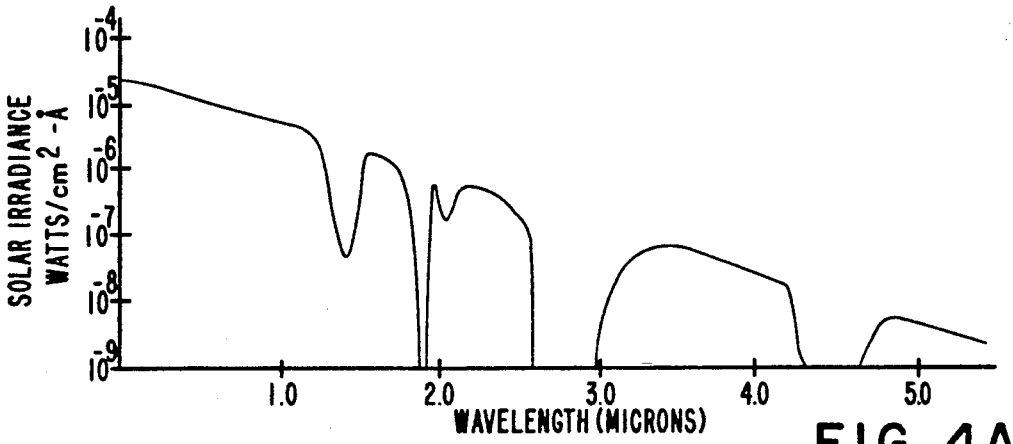
FIGS. 4A through 4D compare solar irradiance at sea level with the spectral emission spectra of a hydrocarbon and non-hydrocarbon fuel flames, and with the dual passband spectrum of the IR sensing channel.
Figure 4B:
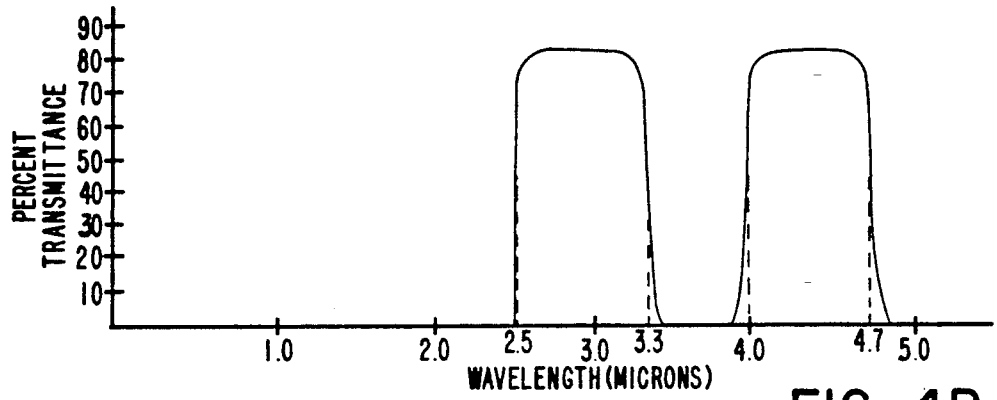

FIG. 4A shows the relative solar spectral irradiance at sea level. Owing to atmospheric absorption of solar radiation by water vapor and carbon dioxide, the solar irradiance level is very small in the two IR spectral regions centered near 2.9 microns and 4.4 microns, which are the center wavelengths of the IR optical dual bandpass filter (3), as shown in FIG. 4B. For this reason, an IR sensor containing the IR optical dual bandpass filter (3) does not respond in a significant way to solar radiation. The small amount of response to solar radiation which occurs in the second optical channel (18) is nulled out on a periodic basis by means of the signal processing circuitry (20) of the fire detector (10). Thus, in the forms of the fire detection systems (10, 40, 60 and 80) shown in FIG. 1, FIGS. 2A, 2B and 2C respectively, solar radiation is prevented from causing a false alarm.

Figure 4C:
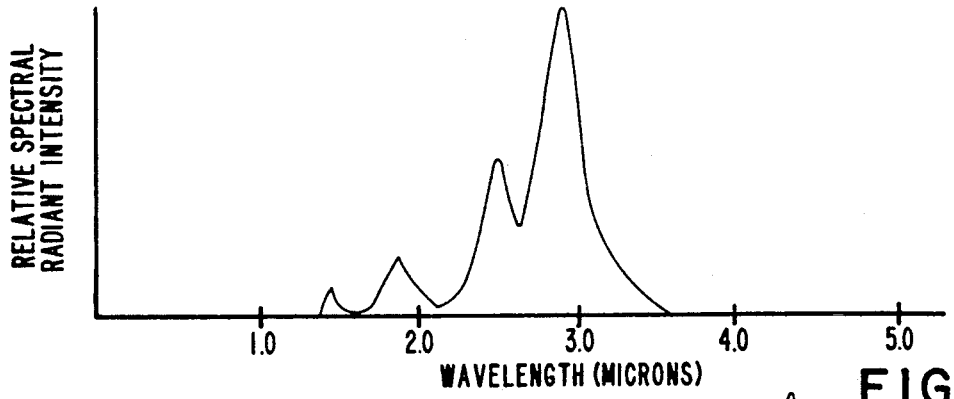

FIG. 4C shows the relative IR emission spectrum from a hydrogen flame, an example of a non-hydrocarbon fire. A broad emission band is present between the IR wavelengths 2.2 microns to 3.4 microns. This is due to the emission from the rotational-vibrational energy states of water vapor generated by the air-oxidation of hydrogen. Since no carbon is present in the fuel, the IR emission spectrum contains no measurable IR emission near the 4.4 micron carbon dioxide emission region. In the fire detector (10) disclosed, the 2.2 micron to 3.4 micron emission band from a hydrogen flame is transmitted effectively through the 2.9 micron component of the IR optical dual bandpass filter (3), where it is sensed by the IR sensor's (2) IR sensor active element (4). Since an air-hydrogen diffusion flame is also known to emit a substantial radiance in the UV spectral region, the UV sensor (1) also senses the radiation from a hydrogen flame. If flame size is sufficiently large, and distance to the fire detector is sufficiently short, the disclosed fire detector (10) will provide an indication of a fire response. This assumes that the relative intensity levels of UV and IR sensor detector signals as input to the signal processing circuitry (20) are within the preset ratio conditions of the fire detector (10).

Figure 4D:
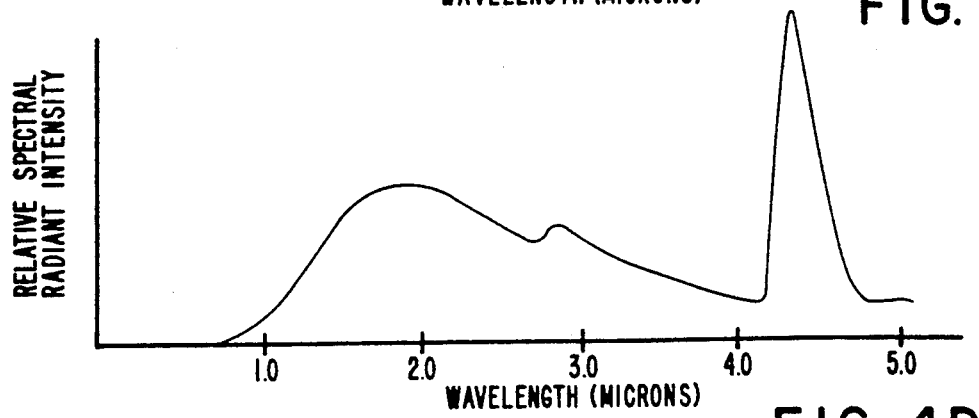

FIG. 4D shows a relative spectrum from a hydrocarbon fuel fire. A significant IR spectral emission level is seen in the region from 1 micron to 5 microns. There is a large emission peak centered near 4.4 microns. It is due to emission from carbon dioxide. The significant emission band in the 1 micron to 3.5 micron region is due to IR band emission from water vapor and carbon dioxide, as well as from blackbody emission associated with heated soot particles in the flame. A hydrocarbon flame such as this is also detected by the invention since IR radiation from the flame is sensed within two spectral band passes centered near 2.9 microns and 4.4 microns. IR radiation is transmitted through the IR optical dual bandpass filter (3) so that it becomes incident upon the IR sensor's (2) IR sensor active element (4). In this way such radiation is sensed by the IR sensor (2). When coupled with a signal of appropriate level from the UV sensor (1), the fire detector (10) then indicates the presence of fire by the same mechanism as was described in the sensing of the hydrogen flame.

It is noteworthy that hydrocarbon flames and certain non-hydrocarbon flames can emit significant levels of IR radiation in spectral regions other than the dual bandpass regions claimed in this invention. However, the sensing of flame in these spectral regions in the presence of sunlight results in high levels of IR sensor (2) response to solar radiation. For example, as shown in FIG. 4D, a typical hydrocarbon fire shows relatively strong IR emission in the 1.5 micron spectral region. Solar irradiance in this region, however, is approximately fifty to one-hundred times higher than the solar irradiance level at 2.9 microns and at 4.4 microns.

The invention utilizes a UV sensor (1), an IR sensor (2), and associated signal processing circuitry (20) as shown in FIG. 1. The invention could be used with other UV sensor types having solar blind spectral characteristics although the present invention was accomplished using a UV sensor designed and manufactured in accordance with U.S. Pat. No. 3,047,761.

Proof-of-principle regarding use of the invention to detect a non-hydrocarbon (hydrogen) fire by means of a UV/IR dual channel detection scheme was accomplished by retrofitting a standard Armtec Model 750 series UV/IR fire detector as described in U.S. Pat. No. 4,455,487 with an IR sensor (2) containing the IR optical dual bandpass filter (3), with the bands centered at 2.9 microns and 4.4 microns. Additionally, a filter window (5) was placed in front of the IR sensor (2) that acted as a wide bandpass IR filter.

The salient feature of the preferred embodiment of the invention, which distinguishes it from other UV/IR optical fire detection methods is the IR optical dual bandpass filter (3). In the preferred embodiment, as shown in FIG. 1, the IR optical dual bandpass filter (3) contained inside the IR sensor (2) has dimensions of 5 millimeters (mm) in length, 5 mm in width, and 0.5 mm in thickness. The IR optical dual bandpass filter (3) is an example of an interference filter. It is composed of a 0.5 mm thick substrate with both sides coated with multiple alternating layers of metal and dielectric films of fractional wavelength thickness. At 0° angle-of-incidence, the IR optical dual bandpass filter (3) shows two spectral components; firstly, it shows a bandpass having center wavelength of 2.9 microns, and secondly, it shows a bandpass having center wavelength of 4.4 microns. Optical transmittance, as shown in FIG. 4B is greater than 85 percent at 2.9 microns and 4.4 microns. For the first bandpass, over the range of 0° to 45° angle-of-incidence, the half power cut-on and cut-off wavelengths span the range from 2.5 microns to 3.3 microns. For the second bandpass over the range of 0° to 45° angle-of-incidence, the half power cut-on and cut-off wavelengths span the range of 4.0 microns to 4.7 microns.

The specific transmission characteristics of the IR optical dual bandpass filter (3) described above were selected so that for non-hydrocarbon fuels such as hydrogen or pure hydrazine, the associated IR sensor (2) will respond to the strong water band IR mission from the flame which largely spans the 2.5 micron to 3.3 micron spectral region. The transmission characteristics were also selected so that the IR sensor (2) would respond to blackbody emission resulting from the hot metal and metal oxides from the burning of certain metals. Such emission is typically stronger in the 2.9 micron spectral region than it is in the 4.4 micron spectral region. The transmission characteristics were also selected such that the same IR sensor (2) will respond to the strong carbon dioxide IR emission band from hydrocarbon flames which largely spans the spectral region of 4.0 microns to 4.7 microns.

Additionally, the above described filter transmission characteristics of the IR optical dual bandpass filter (3) were selected so as to minimize response of the associated IR sensor (2) to direct solar radiation. At sea level, solar irradiance is virtually negligible within the bandpass regions 2.5 microns to 2.9 microns, and from about 4.1 microns to about 4.5 microns. This is due to atmospheric absorption by water vapor of 2.5 micron to 2.9 micron solar radiation and to atmospheric absorption by carbon dioxide of 4.1 micron to 4.5 micron solar radiation.

The present invention can be extended to include the cases where the respective dual bandpasses of the IR optical dual bandpass filter (3) are either made narrower or more broad. However, degradation in performance will occur. For example, if the bandwidths of the IR optical dual bandpass filter (3) are narrowed, a slight reduction in IR sensor (2) response to blackbody radiation and solar radiation will occur, but a significant reduction will occur in response of the IR sensor to flame.

Conversely, if the IR optical dual bandpass filter (3) is designed so that the bandwidths for the respective pass band components is wider than the parameters specified in the invention, the response to solar radiation and blackbody source will increase markedly, while the response of the IR sensor (2) to flame will only improve marginally. In the theoretical limit, the width of the separate pass bands could be broadened so much that they coalesce into a single broad pass band. Again, a marked increase in response to undesired spectral sources such as solar and blackbody radiation would occur. This will greatly increase the number of false alarms generated by the fire detector (10).

In the present invention, the IR optical dual bandpass filter (3) is located within the IR sensor (2). As shown in FIG. 1, the IR sensor (2) so-configured is mounted behind a filter window (5). The filter window (5) serves two purposes. Firstly, it affords mechanical protection to the IR sensor (2), which could be severely damaged by physical impacts. Secondly, the filter window (5) provides a means of optical filtration which further reduces response of the IR sensor to undesired radiation such as solar radiation. In the preferred embodiment, the filter window (5) constitutes a wide bandpass IR filter which transmits IR radiation within the spectral region of 2.5 microns to about 6.0 microns. Only radiation within that bandpass is allowed to impinge upon the IR sensor (2) containing the IR optical dual bandpass filter (3). The result is a more effective blocking or rejection of solar radiation than is afforded by use of the IR sensor (2) containing the IR optical dual bandpass filter (3) without the additional wide bandpass filter window (5). The invention can function without use of this wide bandpass filter window (5), but with reduced effectiveness in rejecting solar radiation.

In addition to the use of a thin film thermopile sensor for the IR sensor active element (4), the invention also allows the use of other IR sensor types, including, but not limited to pyroelectric, photovoltaic, and photoconductive types.

Figure 2A:
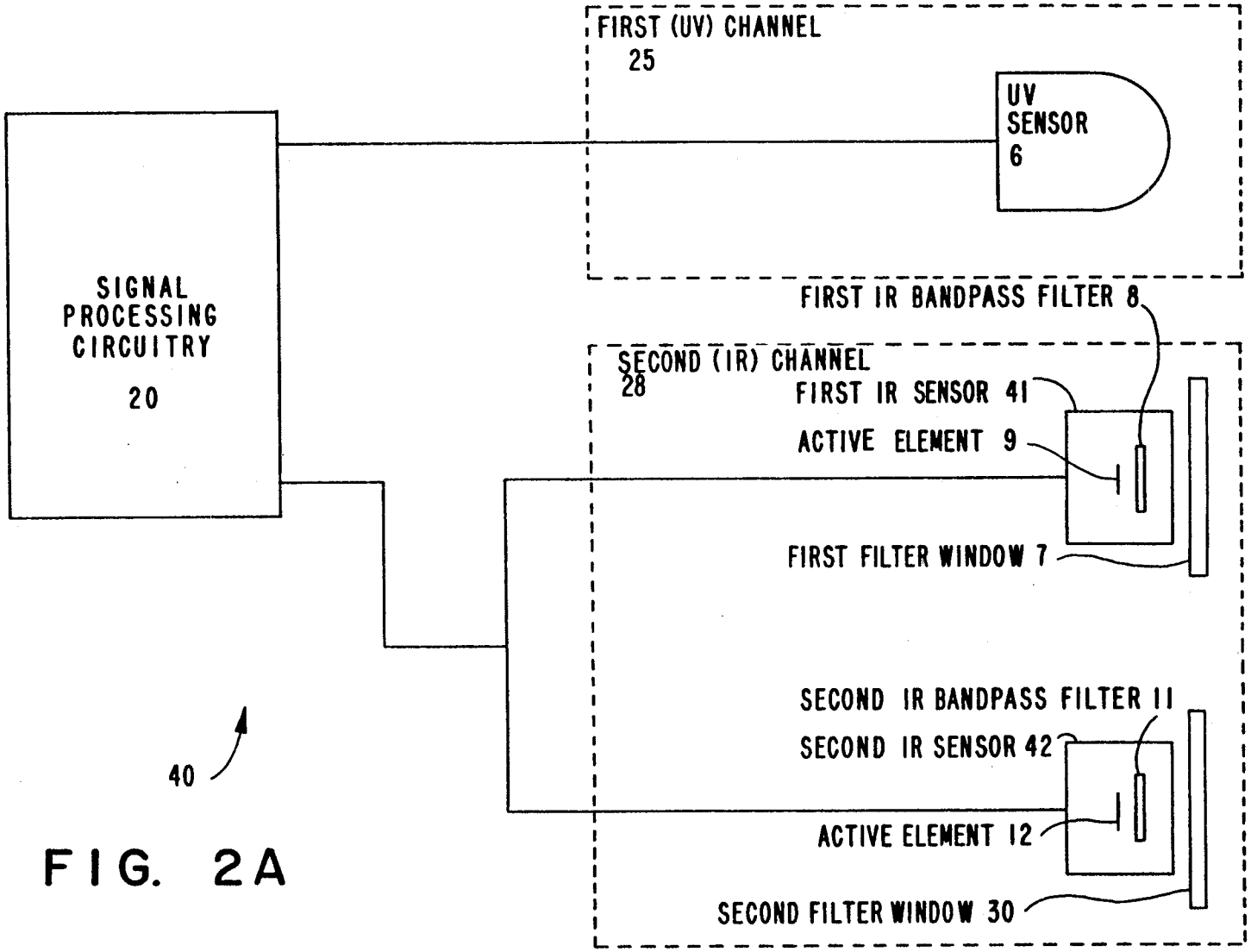
FIGS. 2A, 2B and 2C are block diagrams of alternative embodiments of the invention.

In addition to the preferred embodiment as disclosed, there are several additional means in which the invention can be practiced. One such means is the fire detection system (40) as shown in FIG. 2A. This fire detector (40) utilizes a two channel detection system. The first channel (25) is sensitive to the UV spectral region of 195 nanometers to 275 nanometers. It is comprised of UV sensor (6). The second channel (28) is sensitive to IR radiation centered around the 2.9 micron and the 4.4 micron wavelength band. It is comprised of a first filter window (7), which is a wide bandpass filter, and a first IR sensor (41) comprising a first IR bandpass filter (8) centered at 2.9 microns and a first IR sensor active element (9). The second channel (28) further comprises a second filter window (30), which is a wide bandpass filter, and a second IR sensor (42) comprising a second IR bandpass filter (11) centered at 4.4 microns, and a second IR sensor active element (12). The signal outputs of the first IR sensor (41) and the second IR sensor (42) are then tied together so the output of the second channel (28) can be sent to the signal processing circuitry (20) of the fire detection system. While the performance of this embodiment is nearly identical to that of the preferred embodiment, it is more complex. The addition of the second filter window (30) and the second IR sensor (42) introduces additional cost over the simpler two sensor system of the present invention, and is more difficult to manufacture.

Figure 2B:
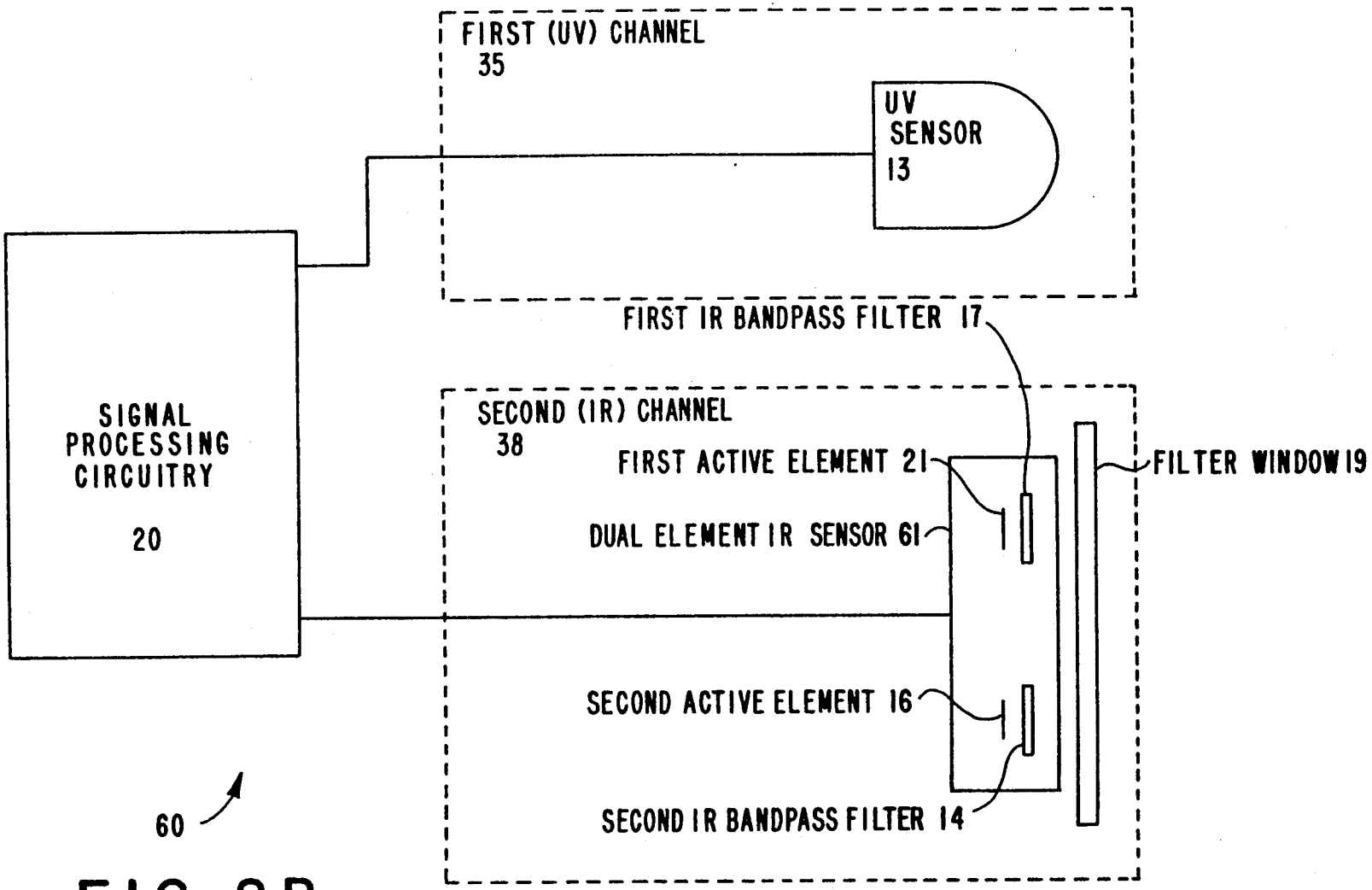

A second such means is the fire detection system (60) as shown in FIG. 2B. This fire detector (60) utilizes a two channel detection system. The first channel (35) is sensitive to the UV spectral region of 195 nanometers to 275 nanometers. It is comprised of a UV sensor (13). The second channel (38) is sensitive to IR radiation and is comprised of a filter window (19) which is a wide bandwidth bandpass filter, and a dual element IR sensor (61) comprising a first IR sensor active element (21), a second IR sensor active element (16), a first IR bandpass filter (17) and a second IR bandpass filter (14). The first IR sensor active element (21) is placed behind the first IR bandpass filter (17) which is centered at 2.9 microns. The second IR sensor active element (16) is placed behind the second IR bandpass filter (14) which is centered at 4.4 microns. Thus, radiation to be detected passes through the filter window (19) and is incident on the dual element IR sensor (61). Any radiation that has passed through the filter window (19) strikes the first IR bandpass filter (17) and the second IR bandpass filter (14). If IR radiation indicative of a fire is present, it will be incident upon the first and second IR sensor active elements (21 and 16). The output signals from the first IR sensor active element (21) and second IR sensor active element (16) are tied together and form the output of the dual element IR sensor (61). The dual element IR sensor (61) containing the first IR sensor active element (21), second IR sensor active element (16), first IR bandpass filter (17) and second IR bandpass filter (14) is a single enclosure. While the performance of this embodiment is nearly identical to that of the preferred embodiment, it is more complex. This complexity is due to the need for two separate IR elements which are each filtered by a separate IR bandpass filter. These additional components add cost, and make manufacture more difficult. To obtain the same responsivity as the IR sensor in the preferred embodiment, a larger package size is needed for the dual element IR detector (61). In order to achieve the same field-of-view and responsivity as the preferred embodiment, the above-described scheme requires a larger, more costly filter window (19) for placement in front of the dual element IR detector (61). The fire detector (10) of the preferred embodiment uses a single IR sensing element (4) and a single IR optical dual bandpass filter (3), which permits the use of a relatively small protective filter window (5). The smaller protective filter window (5) of the preferred embodiment, in combination with a reduction in the number of components, decreases cost, and eases manufacture.

Figure 2C:
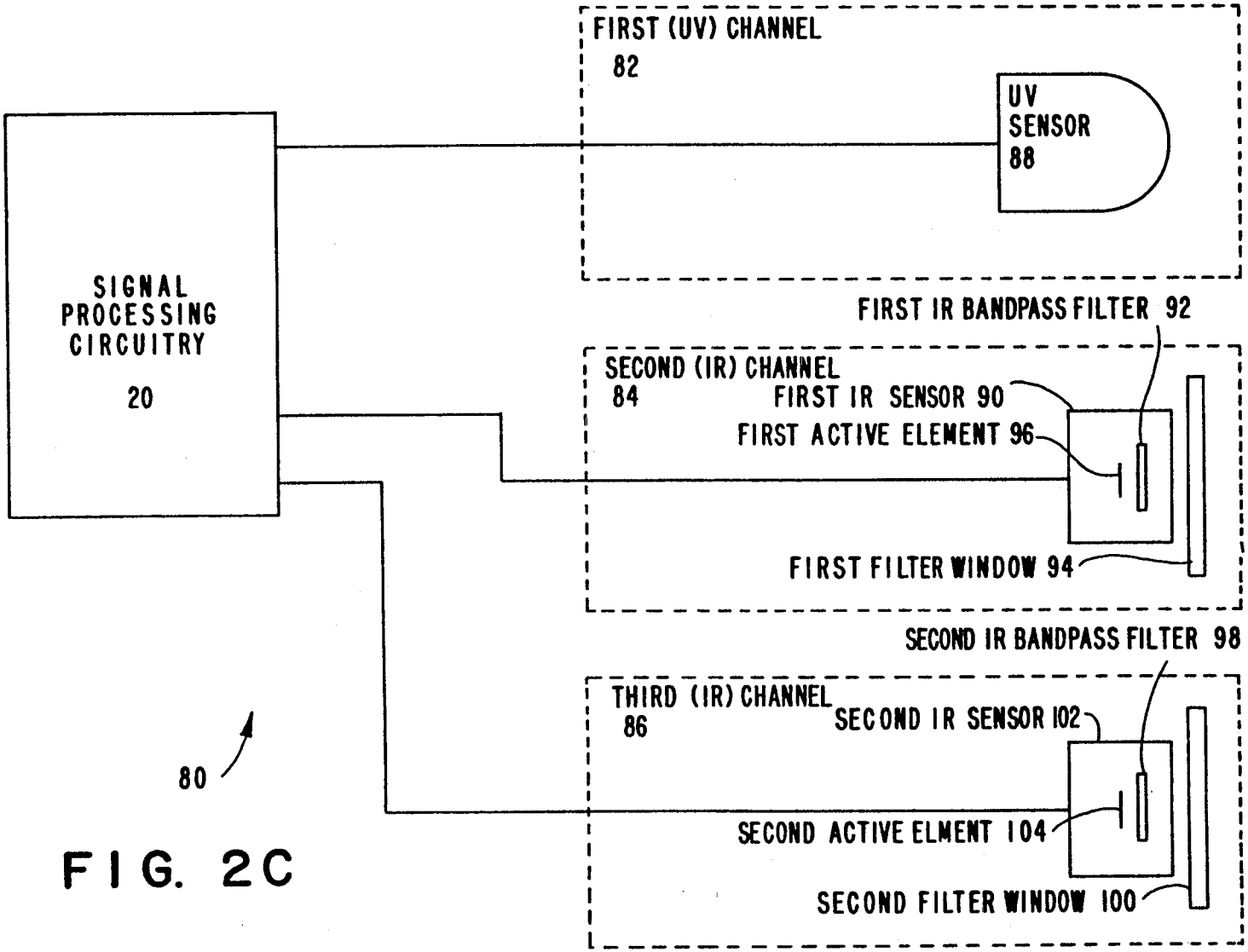

A third such means is the fire detection system (80) as shown in FIG. 2C. This fire detector (80) utilizes a three channel detection system. The first channel (82) is sensitive to the UV spectral region of 195 nanometers to 275 nanometers. It is comprised of a UV sensor (88). The second channel (84) is sensitive to IR radiation centered around the 2.9 micron IR band and is comprised of a first filter window (94), which is a wide bandwidth bandpass filter, and a first IR sensor (90) comprising a first IR sensor active element (96) and a first IR bandpass filter (92). The first IR sensor active element (96) is placed behind the first IR bandpass filter (92) which is centered at 2.9 microns.

The third channel (86) is sensitive to IR radiation centered around the 4.4 micron IR band and is comprised of a second filter window (100), which is a wide bandwidth bandpass filter, and a second IR sensor (102) comprising a second IR sensor active element (104) and a second IR bandpass filter (98). The second IR sensor active element (104) is placed behind the second IR bandpass filter (98) which is centered at 4.4 microns.

Thus, radiation to be detected passes through the first filter window (94) of channel two (84) and the second filter window (100) of channel three (86) and is incident on the first IR sensor (90) and the second IR sensor (102). Any radiation that has passed through the first and second filter windows (94 and 100) strikes the first IR bandpass filter (92) and the second IR bandpass filter (98). If IR radiation indicative of a fire is present, it will be incident upon the first and second IR sensor active elements (96 and 104). The output signal from the first IR sensor active element (96), and thus the second channel (84) are sent to the signal processing circuitry (20). The output from the second IR sensor active element (104), and thus the third channel (86) are sent to the signal processing circuitry as well. While the performance of this embodiment is nearly identical to that of the preferred embodiment, it is more complex. This complexity is due to the need for two separate filter windows, two separate IR active elements and two separate IR bandpass filters. Additional complexity lies in the need for three separate inputs to the signal processing circuitry. These additional components add cost, and make manufacture more difficult. To obtain the same responsivity as the IR sensor in the preferred embodiment, a two separate packages for the IR sensing channels (84 and 86) are necessary. In order to achieve the same field-of-view and responsivity as the preferred embodiment, the above-described scheme requires two separate filter windows (94 and 100) for placement in front of the first and second IR detectors (90 and 102). The fire detector (10) of the preferred embodiment uses a single IR sensing element (4) and a single IR optical dual bandpass filter (3), which permits the use of a relatively small protective filter window (5). The smaller protective filter window (5) of the preferred embodiment, in combination with a reduction in the number of components, decreases cost, and eases manufacture.

Thus it is apparent that there has been provided, in accordance with the invention, a UV/IR fire detector with dual wavelength sensing IR channel that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

We claim:

1. A means for automatically detecting fires fueled by hydrocarbons and by certain non-organics, where the certain non-organics includes hydrogen, hydrazine, magnesium, aluminum, potassium, ammonia and silane, the means having a low incidence of false alarms from incident ultraviolet (UV) and infrared (IR) radiation emitted by non-fire radiation sources, comprising:

ultraviolet (UV) sensing means both for sensing UV wavelength radiation in a predetermined UV spectral region and for generating a first signal corresponding to the sensed UV radiation, said UV spectral region having a predetermined bandwidth selected such that said UV sensing means is both responsive to the incident UV radiation emitted by the fires fueled by the hydrocarbons and responsive to the incident UV radiation emitted by the fires fueled by the certain non-organics but non-responsive to both the incident UV radiation emitted by the sun and to the incident UV radiation emitted by the non-fire radiation sources having wavelength emissions greater than 275 nanometers;

infrared (IR) sensing means both for sensing IR radiation simultaneously in a first IR spectral region and a second IR spectral region and for generating a second signal corresponding to the IR radiation sensed in at least one of said IR spectral regions, said first and second IR spectral regions each being defined by predetermined bandwidths that are separate and distinct from each other;

wherein the predetermined bandwidth for said first IR spectral region is selected such that said IR sensing means is both responsive to the incident IR radiation emitted from the fires fueled by the certain non-organics and responsive to the incident IR radiation emitted from the fires fueled by the hydrocarbons;

wherein the predetermined bandwidth for said second IR spectral region is selected such that said IR sensing means senses the incident IR radiation emitted from the fires fueled by the hydrocarbons;

wherein the predetermined bandwidths of said first and second spectral regions are also established such that said IR sensing means is essentially non-responsive to the incident IR radiation emitted by the sun; and signal processing means both for processing the first signal from said UV sensing means and the second signal from said IR sensing means and for generating a fire signal when the processed first and second signals are indicative of a fire.

2. The fire detection means of claim 1, in which said IR sensing means further comprises:

an IR optical dual bandpass filter being tuned to pass IR radiation that lies in the predetermined bandwidths for said first and second IR spectral regions;

a filter window that filters the incident IR radiation emitted by the fires and the non-fire radiation sources so only a predetermined bandwidth of the incident IR radiation passes therethrough to said IR dual bandpass filter, the predetermined bandwidth of said filter window is established so that at least IR radiation in both the predetermined bandwidths of said first and second spectral regions is passed, said filter window being disposed in front of said IR dual bandpass filter; and an IR sensing element disposed behind said IR dual bandpass filter, said sensing element being responsive to the IR radiation in the predetermined bandwidths of said first and second spectral regions and generating a signal proportional to the incident IR radiation filtered by said filter window and said IR optical dual bandpass filter and being sensed by said IR sensing element.

3. The fire detection means of claim 2, wherein the predetermined bandwidth for said UV spectral region is 195 nanometers to 275 nanometers; wherein the predetermined bandwidth for said first IR spectral region is centered at 2.9 microns; and wherein the predetermined bandwidth for said second IR spectral region is centered at 4.4 microns.

4. The fire detection means of claim 3, wherein the predetermined bandwidth for said filter window is 2.5 microns to 6.0 microns.

5. The fire detection means of claim 4, wherein said IR sensing element is selected from a group consisting of a thin film thermopile sensor, a pyroelectric sensor or a lead selenide sensor.

6. The fire detection means of claim 4, wherein said IR sensing element is an IR sensor that has an unfiltered spectral response which includes the spectral region of 2.0 to 5.0 microns.

7. The fire detection means of claim 1, in which said IR sensing means further comprises:

first and second filter windows, said filter windows filtering the incident IR radiation emitted by the fire and the non-fire radiation sources so only a predetermined bandwidth of the incident IR radiation passes therethrough, the predetermined bandwidth of said filter windows is established so that at least IR radiation in both the predetermined bandwidths of said first and second spectral regions is passed;

a first IR filter disposed behind said first filter window so as to receive the IR radiation passing through said first filter window and being tuned to pass only IR radiation that lies in the predetermined bandwidth for said first IR spectral region;

a second IR filter disposed behind said second filter window so as to receive the IR radiation passing through said second filter window and being tuned to pass only IR radiation that lies in the predetermined bandwidth for said second IR spectral region;

a first IR sensing element disposed behind said first IR filter, said first sensing element being at least responsive to the IR radiation in the predetermined bandwidth of said first spectral region and generating a signal proportional to the incident IR radiation filtered by said first filter window and said first IR filter and being sensed by said first sensing element; and a second IR sensing element disposed behind said second IR filter, said second sensing element being at least responsive to the IR radiation in the predetermined bandwidth of said second spectral region and generating a signal proportional to the incident IR radiation filtered by said second filter window and said second IR filter and being sensed by said second sensing element, wherein the signals generated by said first and said second IR sensing elements are combined to form the second signal to said signal processing means.

8. The fire detection means of claim 7, wherein the predetermined bandwidth for said UV spectral region is 195 nanometers to 275 nanometers; wherein the predetermined bandwidth for said first IR spectral region is centered at 2.9 microns; and wherein the predetermined bandwidth for said second IR spectral region is centered at 4.4 microns.

9. The fire detection means of claim 8, wherein the predetermined bandwidth for said first and second filter windows is 2.5 microns to 6.0 microns.

10. The fire detection means of claim 9, wherein said first and second IR sensing elements are selected from a group consisting of a thin film thermopile sensor, a pyroelectric sensor or a lead selenide sensor.

11. The fire detection means of claim 9, wherein said first and second IR sensing elements are IR sensors that have an unfiltered spectral response which includes the spectral region of 2.0 to 5.0 microns.

12. The fire detection means of claim 1, in which said IR sensing means further comprises:

a filter window that filters the incident IR radiation emitted by the fire and the non-fire sources so only a predetermined bandwidth of the incident IR radiation passes therethrough, the predetermined bandwidth of said filter window is established so that at least IR radiation in both the predetermined bandwidths of said first and second spectral regions is passed;

a first IR filter disposed behind said filter window so as to receive the IR radiation passing through said filter window and being tuned to pass only IR radiation that lies in the predetermined bandwidth for said first IR spectral region;

a second IR filter disposed behind said filter window so as to receive the IR radiation passing through said filter window and being tuned to pass only IR radiation that lies in the predetermined bandwidth for said second IR spectral region;

a first IR sensing element disposed behind said first IR filter, said first sensing element being at least responsive to the IR radiation in the predetermined bandwidth of said first spectral region and generating a signal proportional to the incident IR radiation filtered by said filter window and said first IR filter and being sensed by said first sensing element; and a second IR sensing element disposed behind said second IR filter, said second sensing element being at least responsive to the IR radiation in the predetermined bandwidth of said second spectral region and generating a signal proportional to the incident IR radiation filtered by said filter window and said second IR filter and being sensed by said second sensing element, wherein the signals generated by said first and said second IR sensing elements are combined to form the second signal to said signal processing means.

13. The fire detection means of claim 12, wherein the predetermined bandwidth for said UV spectral region is 195 nanometers to 275 nanometers; wherein the predetermined bandwidth for said first IR spectral region is centered at 2.9 microns; and wherein the predetermined bandwidth for said second IR spectral region is centered at 4.4 microns.

14. The fire detection means of claim 13, wherein the predetermined bandwidth for said filter window is between 2.5 microns and 6.0 microns.

15. The fire detection means of claim 14, wherein said first and second IR sensing elements are are selected from a group consisting of a thin film thermopile sensor, a pyroelectric sensor or a lead selenide sensor.

16. The fire detection means of claim 14, wherein said first and second IR sensing elements are IR sensors that have an unfiltered spectral response which includes the spectral region of 2.0 to 5.0 microns.

17. A fire detection system for automatically detecting fires fueled by hydrocarbons and by certain non-organics, where the certain non-organics includes hydrogen, hydrazine, magnesium, aluminum, potassium, ammonia and silane, the system having a low incidence of false alarms from incident ultraviolet (UV) and infrared (IR) radiation emitted by non-fire radiation sources, comprising:

a first optical sensing channel being configured so as to sense UV wavelength radiation in a predetermined UV spectral region and generating a first signal corresponding to the sensed UV radiation, said UV spectral region having a predetermined bandwidth selected such that said first optical sensing channel is both responsive to the incident UV radiation emitted by the fires fueled by the hydrocarbons and responsive to the incident UV radiation emitted by the fires fueled by the certain non-organics but non-responsive to both the incident UV radiation emitted by the sun and to the incident UV radiation emitted by the non-fire radiation sources having wavelength emissions greater than 275 nanometers;

a second optical sensing channel being configured so as to simultaneously sense IR radiation in a first IR spectral region and a second IR spectral region and to generate a second signal corresponding to the IR radiation sensed in at least one of said spectral regions, said first and second IR spectral regions each being defined by predetermined bandwidths that are separate and distinct from each other;

wherein the predetermined bandwidth for said first IR spectral region is selected such that said second optical channel is both responsive to the incident IR radiation emitted from the fires fueled by the certain non-organics and responsive to the incident IR radiation emitted from the fires fueled by the hydrocarbons;

wherein the predetermined bandwidth for said second IR spectral region is selected such that said second optical sensing channel senses the incident IR radiation emitted from the fires fueled by the hydrocarbons;

wherein the predetermined bandwidths of said first and second IR spectral regions are also established such that said second optical sensing channel is essentially non-responsive to the incident IR radiation emitted by the sun; and signal processing circuitry both for processing said first and said second signals and for generating a fire signal when the processed first and second signals are indicative of a fire.

18. The fire detection system of claim 17, wherein the predetermined bandwidth for said UV spectral region is 195 nanometers to 275 nanometers; wherein the predetermined bandwidth for said first IR spectral region is centered at 2.9 microns; and wherein the predetermined bandwidth for said second IR spectral region is centered at 4.4 microns.

19. The fire detection system of claim 17, in which said second optical sensing channel comprises:

an IR optical dual bandpass filter being tuned to pass IR radiation that lies in the predetermined bandwidths for said first and second IR spectral regions;

a filter window that filters the incident IR radiation emitted by the fire and the non-fire radiation sources so only a predetermined bandwidth of the incident IR radiation passes therethrough to said IR dual bandpass filter, the predetermined bandwidth of said filter window is established so that at least IR radiation in both the predetermined bandwidths of said first and second spectral regions is passed, said filter window being disposed in front of said IR dual bandpass filter; and an IR sensing element disposed behind said IR dual bandpass filter, said sensing element being at least responsive to the IR radiation in the predetermined bandwidths of said first and second spectral regions and generating a signal proportional to the incident IR radiation filtered by said filter window and said IR optical dual bandpass filter and being sensed by said IR sensing element.

20. The fire detection system of claim 19, wherein the predetermined bandwidth for said filter window is 2.5 microns to 6.0 microns.

21. The fire detection system of claim 20, wherein said IR sensing element is selected from a group consisting of a thin film thermopile sensor, a pyroelectric sensor or a lead selenide sensor.

22. The fire detection system of claim 20, wherein said IR sensing element is an IR sensor that has an unfiltered spectral response which includes the spectral region of 2.0 to 5.0 microns.

23. The fire detection system of claim 17, in which said second optical sensing channel comprises:

first and second filter windows, said filter windows filtering the incident IR radiation emitted by the fire and the non-fire radiation sources so only a predetermined bandwidth of the incident IR radiation passes therethrough, the predetermined bandwidth of said filter windows is established so that at least IR radiation in both the predetermined bandwidths of said first and second spectral regions is passed;

a first IR filter disposed behind said first filter window so as to receive the IR radiation passing through said first filter window and being tuned to pass only IR radiation that lies in the predetermined bandwidth for said first IR spectral region;

a second IR filter disposed behind said second filter window so as to receive the IR radiation passing through said second filter window and being tuned to pass only IR radiation that lies in the predetermined bandwidth for said second IR spectral region;

a first IR sensing element disposed behind said first IR filter, said first sensing element being at least responsive to the IR radiation in the predetermined bandwidth of said first spectral region and generating a signal proportional to the incident IR radiation filtered by said first filter window and said first IR filter and being sensed by said first sensing element; and a second IR sensing element disposed behind said second IR filter, said second sensing element being at least responsive to the IR radiation in the predetermined bandwidth of said second spectral region and generating a signal proportional to the incident IR radiation filtered by said second filter window and said second IR filter and being sensed by said second sensing element, wherein the signals generated by said first and said second IR sensing elements are combined to form the second signal to said signal processing circuitry.

24. The fire detection system of claim 23, wherein the predetermined bandwidth for said first and second filter windows is 2.5 microns to 6.0 microns.

25. The fire detection system of claim 24, wherein said first and second IR sensing elements are selected from a group consisting of a thin film thermopile sensor, a pyroelectric sensor or a lead selenide sensor.

26. The fire detection system of claim 24, wherein said first and second IR sensing elements are IR sensors that have an unfiltered spectral response which includes the spectral region of 2.0 to 5.0 microns.

27. The fire detection system of claim 17, in which said second optical sensing channel further comprises:

a filter window that filters the incident IR radiation emitted by the fire and the non-fire radiation sources so only a predetermined bandwidth of the incident IR radiation passes therethrough, the predetermined bandwidth of said filter window is established so at least IR radiation in both the predetermined bandwidths of said first and second spectral regions is passed;

a first IR filter disposed behind said filter window so as to receive the IR radiation passing through said filter window and being tuned to pass only IR radiation that lies in the predetermined bandwidth for said first IR spectral region;

a second IR filter disposed behind said filter window so as to receive the IR radiation passing through said filter window and being tuned to pass only IR radiation that lies in the predetermined bandwidth for said second IR spectral region;

a first IR sensing element disposed behind said first IR filter, said first sensing element being at least responsive to the IR radiation in the predetermined bandwidth of said first spectral region and generating a signal proportional to the incident IR radiation filtered by said filter window and said first IR filter and being sensed by said first sensing element; and a second IR sensing element disposed behind said second IR filter, said second sensing element being at least responsive to the IR radiation in the predetermined bandwidth of said second spectral region and generating a signal proportional to the incident IR radiation filtered by said filter window and said second IR filter and being sensed by said second sensing element, wherein the signals generated by said first and said second IR sensing elements are combined to form the second signal to said signal processing circuitry.

28. The fire detection system of claim 27, wherein the predetermined bandwidth for said filter window is 2.5 microns to 6.0 microns.

29. The fire detection system of claim 28, wherein said first and second IR sensing elements are are selected from a group consisting of a thin film thermopile sensor, a pyroelectric sensor or a lead selenide sensor.

30. The fire detection system of claim 28, wherein said first and second IR sensing elements are IR sensors that have an unfiltered spectral response which includes the spectral region of 2.0 to 5.0 microns.

31. An infrared (IR) detector for detecting IR radiation emitted by fires fueled by hydrocarbons and by certain non-organics, where the certain non-organics includes hydrogen, hydrazine, magnesium, aluminum, potassium, ammonia and silane, comprising:

an IR optical dual bandpass filter being tuned to pass IR radiation in both a first and second IR spectral region, said first and second spectral regions each being defined by predetermined bandwidths that are separate and distinct from each other;

a filter window that filters the incident IR radiation emitted by the fire and the non-fire radiation sources so only a predetermined bandwidth of the incident IR radiation passes therethrough to said IR duel bandpass filter, the predetermined bandwidth of said filter window is established so that at least IR radiation in both the predetermined bandwidths of said first and second spectral regions is passed, said filter window being disposed in front of said IR duel bandpass filter; and an IR sensing element, disposed behind said IR dual bandpass filter, being at least responsive to the IR radiation in the predetermined bandwidths of said first and second IR spectral regions and generating a signal proportional to the incident IR radiation, filtered by said filter window and said IR optical dual bandpass filter, sensed in at least one of said IR spectral regions, wherein the predetermined bandwidth for said first IR spectral region is selected such that said IR sensing element is both responsive to the incident IR radiation emitted from the fires fueled by the certain non-organics and responsive to the incident IR radiation emitted from the fires fueled by the hydrocarbons, the predetermined bandwidth for said second IR spectral region is selected such that said IR sensing element is responsive to the incident IR radiation emitted from the fires fueled by the hydrocarbons, the predetermined bandwidths of said first and second IR spectral regions are also established such that said IR sensing element is essentially non-responsive to the incident IR radiation emitted by the sun.

32. The IR detector of claim 31, wherein the predetermined bandwidth for said first IR spectral region is centered at 2.9 microns and the predetermined bandwidth for said second IR spectral region is centered at 4.4 microns.

33. The IR detector of claim 32, wherein the predetermined bandwidth for said filter window is 2.5 microns to 6.0 microns.

34. The IR detector of claim 33, wherein said IR sensing element is selected from a group consisting of a thin film thermopile sensor, a pyroelectric sensor or a lead selenide sensor.

35. The IR detector of claim 34, wherein said IR sensing element is an IR sensor that has an unfiltered spectral response which includes the spectral region of 2.0 to 5.0 microns.

36. A fire detection system for automatically detecting fires fueled by hydrocarbons and by certain non-organics, where the certain non-organics includes hydrogen, hydrazine, magnesium, aluminum, potassium, ammonia and silane, the system having a low incidence of false alarms from incident ultraviolet (UV) and infrared (IR) radiation emitted by non-fire radiation sources, comprising:

a first optical sensing channel being configured so as to sense UV wavelength radiation in a predetermined UV spectral region and generating a first signal corresponding to the sensed UV radiation, said UV spectral region having a predetermined bandwidth selected such that said first optical sensing channel senses both the incident UV radiation emitted by the fires fueled by the hydrocarbons and the incident UV radiation emitted by the fires fueled by the certain non-organics but is essentially non-responsive to both the incident UV radiation emitted by the sun and to the incident UV radiation emitted by the non-fire radiation sources having wavelength emissions greater than 275 nanometers;

a second optical sensing channel being configured to sense IR radiation in a first IR spectral region and to generate a second signal corresponding to the sensed IR radiation, said first IR spectral region being defined by a predetermined bandwidth, wherein the predetermined bandwidth for said first IR spectral region is selected such that said second optical channel senses both the incident IR radiation emitted from the fires fueled by the certain non-organics and the incident IR radiation emitted by the fires fueled by the hydrocarbons;

a third optical sensing channel being configured to sense IR radiation in a second IR spectral region, and to generate a third signal corresponding to the sensed IR radiation, said second IR spectral region being defined by a predetermined bandwidth separate and distinct from the bandwidth for said first IR spectral region, wherein the predetermined bandwidth for said second IR spectral region is selected such that said third optical sensing channel senses the incident IR radiation emitted from the fires fueled by the hydrocarbons;

wherein the predetermined bandwidths of said first and second IR spectral regions are also established such that said second and third optical sensing channels are essentially non-responsive to the incident IR radiation emitted by the sun; and signal processing circuitry both for processing said first, said second and said third signals and for generating a fire signal when the processed first and second signals are indicative of a fire fueled by the certain non-organics or when the processed first, second and third signals are indicative of a fire fueled by the hydrocarbons.

37. The fire detection system of claim 36, wherein the predetermined bandwidth for said UV spectral region is 195 nanometers to 275 nanometers; wherein the predetermined bandwidth for said first IR spectral region is centered at 2.9 microns; and wherein the predetermined bandwidth for said second IR spectral region is centered at 4.4 microns.

38. The fire detection system of claim 36, in which said second optical sensing channel comprises:

a first filter window, said filter window filtering the incident IR radiation emitted by the fire and the non-fire radiation sources so only a predetermined bandwidth of the incident IR radiation passes therethrough, the predetermined bandwidth of said filter window is established so at least IR radiation in both the predetermined bandwidths of said first and second IR spectral regions is passed;

a first IR filter disposed behind said first filter window so as to receive the incident IR radiation passing therethrough and being tuned to pass IR radiation that lies in the predetermined bandwidth for said first IR spectral region; and a first IR sensing element disposed behind said first IR filter, said first sensing element being at least responsive to the IR radiation in the predetermined bandwidth of said first spectral regions and generating a signal proportional to the sensed IR radiation.

39. The fire detection system of claim 38, wherein the predetermined bandwidth for said first filter window is 2.5 microns to 6.0 microns.

40. The fire detection system of claim 39, wherein said first IR sensing element is selected from a group consisting of a thin film thermopile sensor, a pyroelectric sensor or a lead selenide sensor.

41. The fire detection system of claim 39, wherein said IR sensing element is an IR sensor that has an unfiltered spectral response which includes the spectral region of 2.0 to 5.0 microns.

42. The fire detection system of claim 36, in which said third optical sensing channel comprises:

a second filter window, said filter window filtering the incident IR radiation emitted by the fire and the non-fire radiation sources so only a predetermined bandwidth of the incident IR radiation passes therethrough, the predetermined bandwidth of said filter window is established so at least IR radiation in both the predetermined bandwidths of said first and second IR spectral regions is passed;

a second IR filter disposed behind said second filter window so as to receive the incident IR radiation passing therethrough and being tuned to pass IR radiation that lies in the predetermined bandwidth for said second IR spectral region; and a second IR sensing element disposed behind said second IR filter, said second sensing element being at least responsive to the IR radiation in the predetermined bandwidth of said second spectral region and generating a signal proportional to the sensed IR radiation.

43. The fire detection system of claim 42, wherein the predetermined bandwidth for said second filter window is 2.5 microns to 6.0 microns.

44. The fire detection system of claim 43, wherein said second IR sensing element is selected from a group consisting of a thin film thermopile sensor, a pyroelectric sensor or a lead selenide sensor.

45. The fire detection system of claim 43, wherein said IR sensing element is an IR sensor that has an unfiltered spectral response which includes the spectral region of 2.0 to 5.0 microns.

46. A method for automatically detecting fires fueled by hydrocarbons and by certain non-organics, where the certain non-organics includes hydrogen, hydrazine, magnesium, aluminum, potassium, ammonia and silane, the method having a low incidence of false alarms from incident ultraviolet (UV) and infrared (IR) radiation emitted by non-fire radiation sources, comprising the steps of:

sensing UV wavelength radiation in a predetermined UV spectral region having a predetermined bandwidth, the bandwidth being established such that the incident UV radiation emitted by the fires fueled by the hydrocarbons and the incident UV radiation emitted by the fires fueled by the certain non-organics is sensed but the incident UV radiation emitted by both the sun and by the non-fire radiation sources having wavelength emissions greater than 275 nanometers is excluded;

generating a first signal corresponding to the incident UV radiation sensed;

selectively filtering the incident IR radiation emitted by the fire and non-fire radiation sources into a first and second IR spectral region, the first and second spectral regions each being defined by predetermined bandwidths that are separate and distinct from each other;

wherein said selectively filtering further includes selecting predetermined bandwidths for the first and second spectral regions so that said selectively filtering of the incident IR radiation in a first spectral region filters the incident IR radiation emitted so that only predetermined IR spectra emitted by the fires fueled by the certain non-organics and the fires fueled by the hydrocarbons is transmitted and so that said selectively filtering of the incident IR radiation in a second spectral region filters the incident IR radiation emitted so that only predetermined IR spectra emitted by the fires fueled by the hydrocarbons is transmitted;

simultaneously sensing the selectively filtered IR radiation and generating a second signal corresponding to the incident IR radiation sensed in at least one of said spectral regions;

processing the first and the second signals; and generating a fire signal when the processed first and second signals are indicative of a fire.

47. The method for automatically detecting fires of claim 46, further including the step of pre-filtering the incident IR radiation emitted by the fire and non-fire radiation sources so that only IR radiation in a third predetermined IR spectral region is transmitted, before said selectively filtering IR radiation into first and second spectral regions.

* * * * *

UNITED STATES PATENT AND TRADEMARK OFFICE

CERTIFICATE OF CORRECTION

PATENT NO. : 5,311,167

DATED : May 10, 1994

INVENTOR(S) : Plimpton et al.

It is certified that error appears in the above-indentified patent and that said Letters Patent is hereby corrected as shown below:

Column 3, line 36, delete "carbondioxide" and replace therewith -- carbon dioxide--.

Column 4, line 44, delete "UV/IR fire fire" and replace therewith --UV/IR fire--.

Column 5, line 12, delete "arc,welding" and replace therewith -- arc welding --.

Column 10, lines 32-33, delete the line break between "is" and "sensitive."

Column 17, lines 40 and 46 (i.e, Lines 15, 20 of Claim 31) delete "duel" and replace therewith --dual-- (both occurrences).

Signed and Sealed this

Fourth Day of October, 1994

Bruce Lehman

*Attest:*

BRUCE LEHMAN

*Attesting Officer*

*Commissioner of Patents and Trademarks*